United States Patent [19]

Chalabian

[11] Patent Number: 4,718,532

[45] Date of Patent: Jan. 12, 1988

[54] COIN OPERATED VENDING MACHINES FOR NEWSPAPERS OR THE LIKE

[75] Inventor: Jack S. Chalabian, Huntington Beach, Calif.

[73] Assignee: K-Jack Engineering Co., Inc., Gardena, Calif.

[21] Appl. No.: 810,676

[22] Filed: Dec. 19, 1985

[51] Int. Cl.[4] ..... G07F 11/02

[52] U.S. Cl. ..... 194/350; 49/386; 221/155

[58] Field of Search ..... 194/350, 233, 248, 227, 194/226; 221/155; 312/118, 120; 232/15, 16; 49/386; 16/58

[56] References Cited

U.S. PATENT DOCUMENTS

| | | | |
|---|---|---|---|
| 1,803,440 | 5/1931 | Schefield | 184/233 |
| 3,259,937 | 7/1966 | Kotikov | 16/58 X |
| 3,353,743 | 11/1967 | Amundsen | 232/15 |
| 3,747,733 | 7/1973 | Knickerbocker | 221/155 X |
| 4,037,701 | 7/1977 | Knickerbocker | 194/227 |
| 4,506,776 | 3/1985 | Voegeli | 194/350 |
| 4,544,081 | 10/1985 | Voegeli | 194/350 X |
| 4,579,214 | 4/1986 | Vock | 194/350 |

FOREIGN PATENT DOCUMENTS

| | | | |
|---|---|---|---|
| 1250795 | 10/1971 | United Kingdom | 194/350 |

*Primary Examiner*—F. J. Bartuska

*Attorney, Agent, or Firm*—Beehler, Pavitt, Siegemund, Jagger, Martella & Dawes

[57] ABSTRACT

An improved vending machine having an enclosure for storage of articles and an access door is provided with an arm affixed to the door and which has a free end, with a hydraulic door closer connected between the free end and the machine. A stop element is affixed to the machine enclosure and projects into the door opening of the access door for stopping movement of the arm thereby to limit the opening movement of the door and thus prevent application of excessive force to the hydraulic door closer. The vending machine also includes a latch hook releasably engageable with the stop element for restraining the door in an open position against return to a closed position.

6 Claims, 10 Drawing Figures

COIN OPERATED VENDING MACHINES FOR NEWSPAPERS OR THE LIKE

BACKGROUND OF THE INVENTION

1. Field of the Invention

The present invention pertains generally to the field of coin operated vending machines, and is more particularly directed to certain improvements in vending machines for newspaper, magazine or other printed material.

2. State of the Prior Art

The improvements disclosed herein relate in particular to newsprint or magazine vending machines having a primary or main enclosure housing for storing the articles to be vended, usually in the form of a stack of newspapers, an access door in the primary enclosure which is normally locked by means of a coin operated door locking mechanism. A purchaser deposits the required coinage in the coin operated mechanism to unlock the door which can then be opened for access to and retrieval of the purchased article from the primary enclosure. In existing vending machines the coin operated locking mechanism is often mounted in a separate smaller secondary enclosure mounted on top of the primary enclosure. In such machines the access door is of the "pull-down" type, i.e., hinged at its lower edge to the primary enclosure and has a latch at its upper end which engages with the coin operated door lock. This style of vending machine is well known in the prior art. It has been the practice to provide a coin box under the coin sorting mechanism which receives and accumulates the coinage deposited by patrons for subsequent collection and retrieval by the vending machine operator. The coin box has in the past been enclosed within the secondary housing which also contains the coin actuated door lock. One difficulty with this arrangement is that access to the coin actuated lock is required by machine service and maintenance personnel for the purpose of changing the coinage settings of the coin sorting mechanism i.e. as between the price of a weekday newspaper edition and the Sunday edition. Such personnel is not necessarily authorized to remove and collect the coins accumulated in the coin box, and it is therefore desirable to restrict access of such personnel to the coin box. This is not possible in prior art machines of the aforedescribed design. Furthermore, the secondary housing affixed to the top of the primary machine enclosure is relatively exposed and more readily subject to vandalism and tampering by individuals attempting to break into the coin mechanism with the intent of appropriating the currency accumulated therein.

A further improvement disclosed herein relates to the display of a copy of the newspaper or publication being vended through a window in the access door to the primary enclosure of the machine. It has been common practice to provide such a window with a transparent sheet of glass or plastic and some means for supporting a copy of the printed publication behind and against the window pane for viewing by prospective patrons. The usual arrangement has only allowed the display of the upper half of the newspaper front page which was folded in half for insertion into the display window. It is desirable however to display entire front page of the newspaper. However, no convenient, reliable and low cost means has been available which would allow service personnel to quickly drop a display copy of a newspaper into place without wasting time to arrange and secure the display copy in proper viewing position.

SUMMARY OF THE INVENTION

The present invention proposes solutions to these and other shortcoming of the prior art. In a first improvement disclosed herein, the problem of independent access to the coin operated door lock and coin box is overcome by providing a coin safe mounting for the coin box within the primary enclosure of the vending machine and under a coin drop opening defined in the upper wall of the main enclosure. The coin box is secured in place under said coin drop opening by means of a coin box lock such as a paddlock. The coin box is mounted in a coin safe arrangment which prevents access to its contents by patrons reaching into the main enclosure for retrieving purchased articles. However, the paddlock is readily accessible to authorized personnel by opening the access door to the primary enclosure and and the coin box is easily extracted and emptied by unlocking the padlock. The coin box is thus removed from the secondary housing and not accessible to service personnel working on the coin actuated lock, while authorized personnel supplied with a key for opening the coin box lock have ready independent access to the contents of the coin box through the access door of the main enclosure.

Since in many cases, access to the coin actuated lock is only sporadically required while collection of coinage in the coin box is more frequently desirable, the present invention further improves over the prior art in that the coin box lock is enclosed in the primary enclosure of the vending machine and is thus protected against dirt, moisture and ice which in prior art machines have made the task of unlocking the coin box unpleasant and where exposure to the elements has been detrimental to the easy and proper operation of the coin box lock.

Vending machines having pull-down access doors, i.e. an access door hinged at its lower end to the primary machine housing and having a coin actuated lock mechanism engageable to its upper end are further improved by the present invention in that a backing plate is provided behind the display window pane, which backing plate is mounted to the access door by guide means operative for directing the backing plate to a spaced position in relation to the window pane when upward pulling force is applied to the plate and returning the backing plate towards the window pane when released. A display copy of newspaper or the like can be easily dropped into place between the backing plate and the display window pane. A suitable bottom support such as a flange or lip running horizontally under the display window is provided for supporting the display copy in alignment with the window opening. The plate support arrangement is configured so as to return the backing plate against the display copy and towards window pane when the backing plate is released from the aforementioned spaced position. Preferably, the backing plate is allowed to slide along suitable guides under its own weight when it is released by the machine service person after the display copy has been slipped into place between the spaced backing plate and the display window pane. The backing plate in effect thus falls into supporting position and holds the display copy flat against the window pane for easy viewing from the exterior of the vending machine. This latter improvement allows very quick exchange of display copies which is necessary on a daily basis in cases where a daily newspaper is being vended. Furthermore, the installation of the display copy can be made with virtually no attention by the service person as to the proper positioning and support of the display copy due to the simple and nearly fool-proof construction and operation of the display system.

A still further aspect of the present invention is directed to an improved access door spring loading and limiting arrangement whereby the door may be latched in an open position against spring loading to facilitate resupplying and servicing of the vending machine. In prior art machines it was common for the service person to have to hold open the access door while restocking the machine, resulting in considerable inconvenience and delay.

These and other improvements over the prior art will be better understood by reference to the following detailed description of the preferred embodiments taken in light of the attached drawings.

DETAILED DESCRIPTION OF THE PREFERRED EMBODIMENTS

Figure 1:
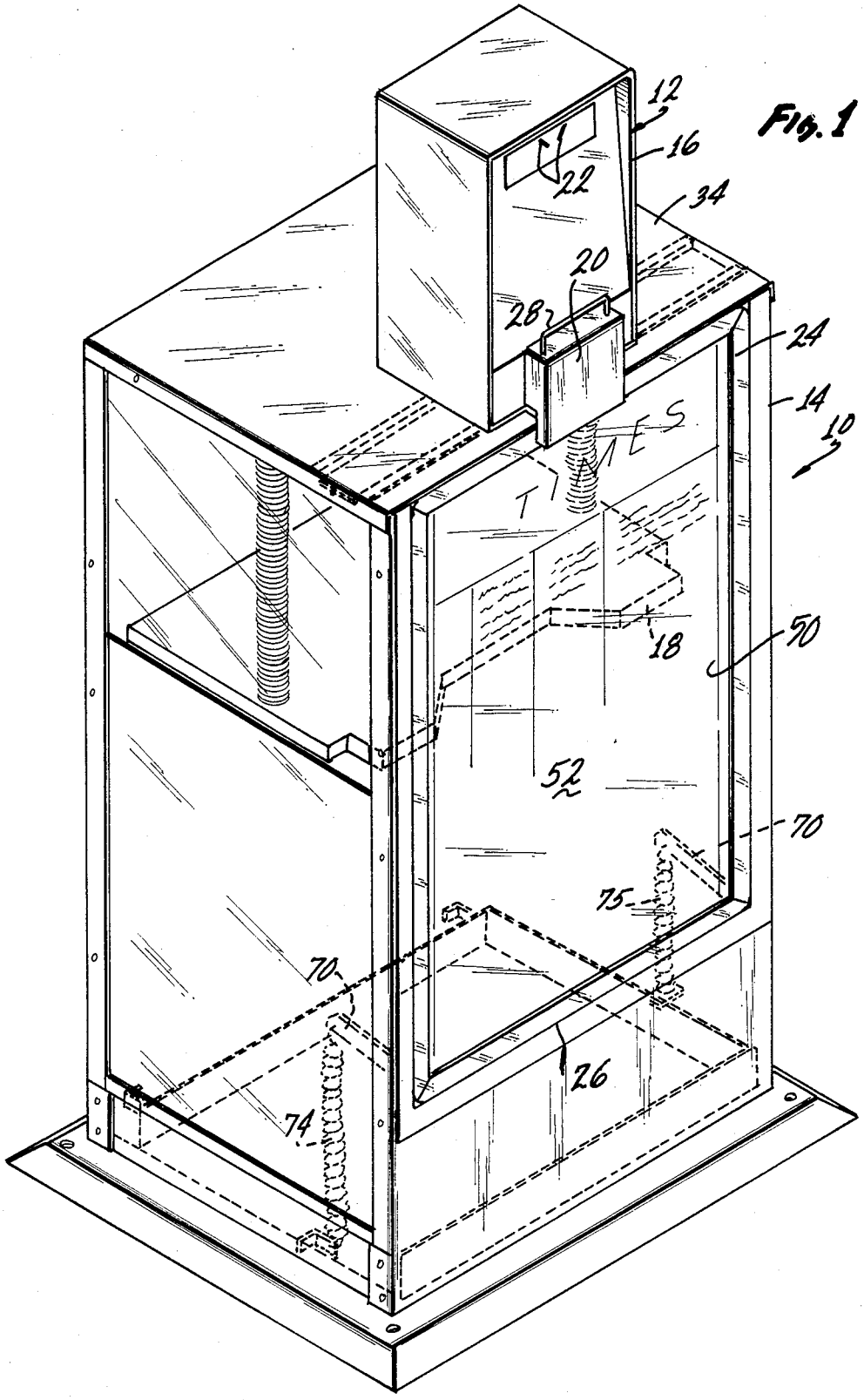
FIG. 1 is perspective view of a vending machine improved according to the present invention.
Figure 2:
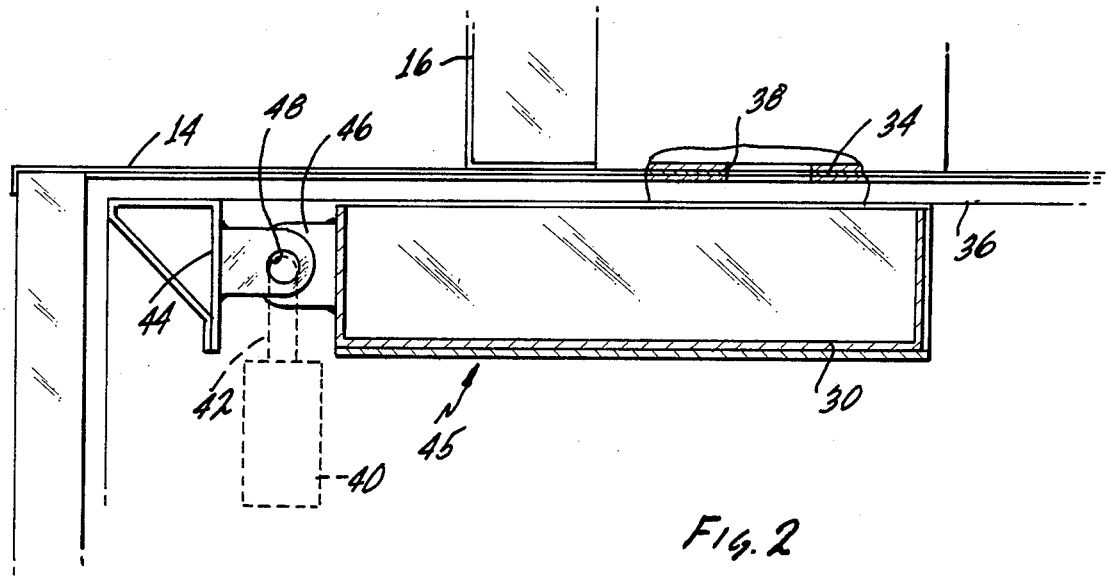
FIG. 2 is a fragmentary vertical view taken in elevation showing the internal mounting of the coin box.
Figure 3:
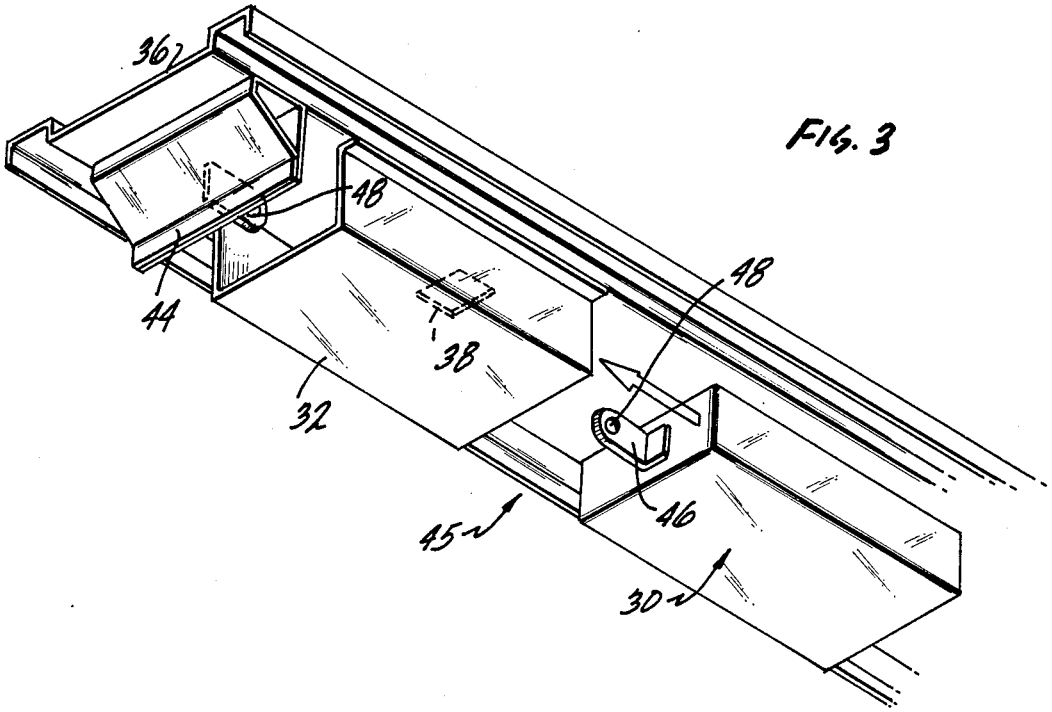
FIG. 3 is partial perspective view showing the novel coin box arrangement.
Figures 6, 7:
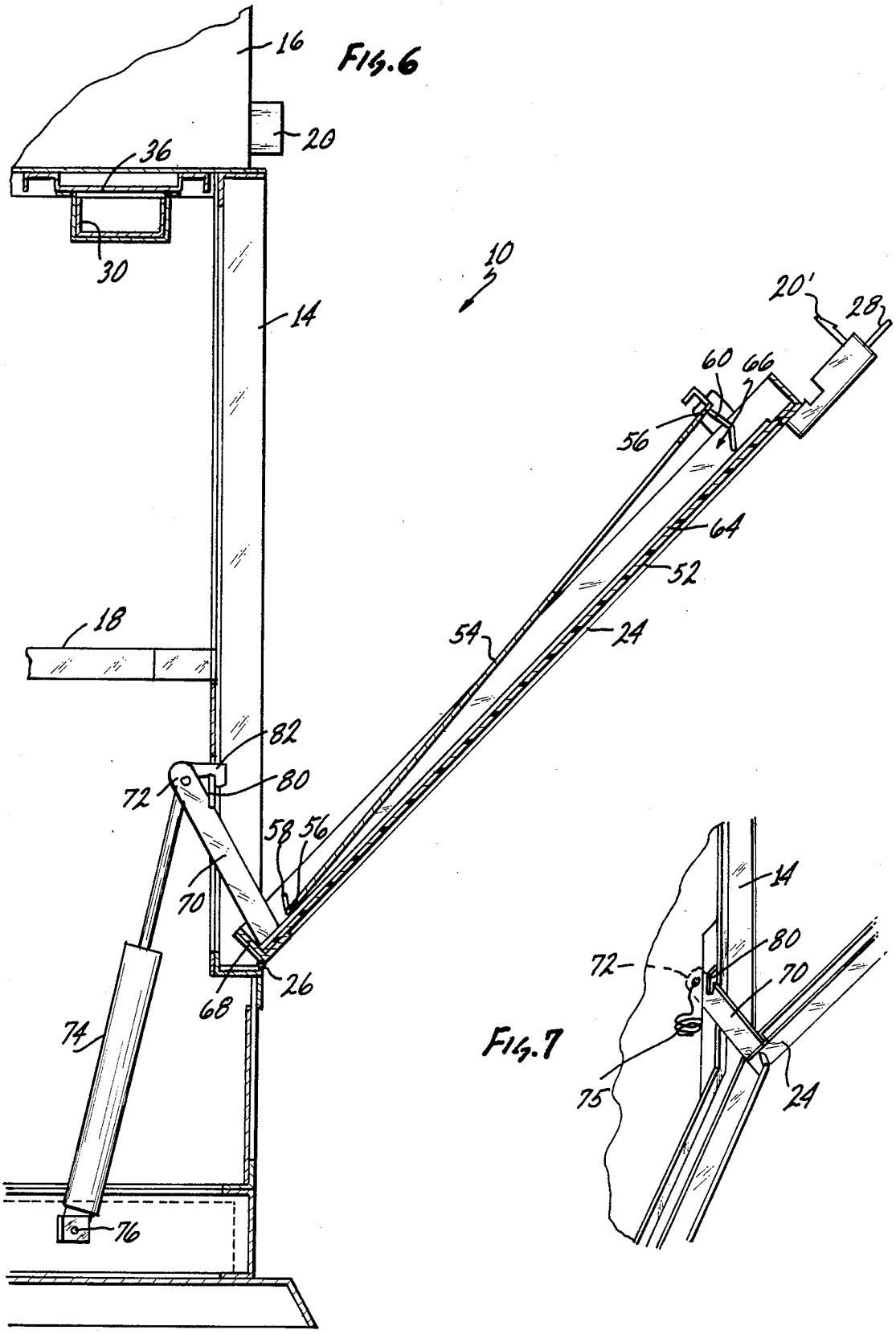
FIG. 6 is a sectional view as in FIG. 4 showing the access door in open position and the display arrangement open for insertion of a display copy thereinto.
FIG. 7 shows a latch mechanism for holding the access door open against a hydraulic door closer.

With reference to the drawings, FIG. 1 shows a newspaper vending machine 10 improved according to the present invention. A first improvement relates to a modification of the coin operated door lock assembly 12 mounted on top of the primary housing 14 and enclosed in a secondary enclosure or housing 16. The primary housing 14 encloses a vertically slideable spring loaded stacking shelf 18 on which are stacked the articles to be vended. The primary housing 14 normally prevents access to articles stored therein until sufficient coinage is inserted through slot 22 of the coin operated mechanism 12 so as to release the door lock 20. When so released, a pull-down access door 24 hinged to the primary enclosure 14 at its lower end 26 may be opened by pulling outwardly on upper handle 28 so as to open the door as shown in FIG. 6. The door 24 is provided with a latch 20' which is released by the door locking mechanism 20 upon insertion of sufficient coinage. The construction and operation of the coin actuated lock is well known in the art and need not be described here. A common feature however found in most coin actuated lock mechanisms in use with vending machines of this type is a coin box or equivalent receptacle generally underlying the coin sorting mechanism for receiving coinage accepted by the sorting mechanism for periodic collection by the vending machine operator. In the present invention such a coin box 30, best seen in FIGS. 2 and 3, consisting of an open rectangular box having a bottom four-side walls is supported within a safe enclosure consisting of a bracket 32 having a U-shaped cross section affixed with its open top side to a cover plate 36, the latter being affixed to the underside of the top wall 34 of the primary enclosure 14. The bracket 32 is dimensioned to slidingly and snugly receive in drawer fashion the coin box 30. The coin box 30 is thus supported by bracket 32 and covered by the plate 36 underneath a coin drop opening 38 formed through the bottom of the secondary enclosure, the top wall 34 of the main housing 14 as well as the plate 36. Coins accepted by the sorting mechanism mounted within the secondary enclosure 16 fall through the coin drop opening 38 from the secondary enclosure 16 into the primary enclosure 14 and into the underlying coin box 30. The coin box 30 is secured against removal from the bracket 32 and in position underneath the coin drop opening 38 by means of a paddlock or similar lock device 40 (shown in dotted lining in FIG. 2) which has a shackle 42 passing through aligned holes in a retaining bracket 44 welded to the underside of cover plate 36 and a perforated tab 46 welded to an end wall of the coin box 30. When the shackle 42 of a paddlock or similar device passes through the aligned openings 48, the coin box 30 is enclosed along its entire length, i.e. in the direction of cover plate 36, within the supporting bracket 32. The length of the bracket 32 should therefore be at least approximately equal to the length of the coin box 30. At the same time, the coin box 30 is easily accessed and removed for collecting its contents by first opening the access door 24 into the primary enclosure 14, then unlocking the coin box lock 40, removing the shackle 42 from the aligned bracket openings 48, and then pushing the coin box 30 away from the retaining bracket 44 and out of the supporting bracket 32. It will be appreciated that the coin box 30 is safe-guarded against forcible break-in or vandalism. In typical vending machines the outer walls of the primary enclosure 14 including the top wall 34 thereof tend to be made of relatively thin gauge metal or occasionally of plastic material which can be relatively easily cut through for access into the enclosure. The coin safe assembly as seen in FIGS. 2 and 3 consisting of the coin box 30 enclosed between the supporting bracket 32 and the reinforcing cover plate 36 and held within the bracket 32 by means of the retaining bracket 44 and a suitable lock 40, in effect constitutes a coin safe 45 which does not permit access to the contents of the coin box 30 even if the main enclosure 14 is broken into. The coin safe components can be readily and inexpensively made of thicker gauge sheet metal so that even if the entire coin safe assembly 45 is torn out of the enclosure 14 the would-be thief is left holding the closed assembly 45 of FIG. 3 and would still have to perform substantial work on the coin safe assembly in terms of cutting and prying open portions thereof to gain access to the contents of coin box 30. Furthermore, the relative close spacing between the supporting bracket 32 and the anchor bracket 44 protects the shackle 42 of the paddlock 40 against access with bolt cutters even if the entire coin safe assembly of FIG. 3 were torn out of the vending machine.

According to the present invention therefore, the coin box 30 is removed from the secondary enclosure 16, isolating access to the coin box from personnel having access to the secondary enclosure 16 for the purpose of maintaining the coin actuated lock mechanism therein. Nevertheless, access to the coin box 30 remains easy and quick to someone equipped with a key to the coin lock 40. Further, the coin lock 40 is protected within the primary enclosure 14 against the elements for easier, more pleasant work with the same.

Figure 4:
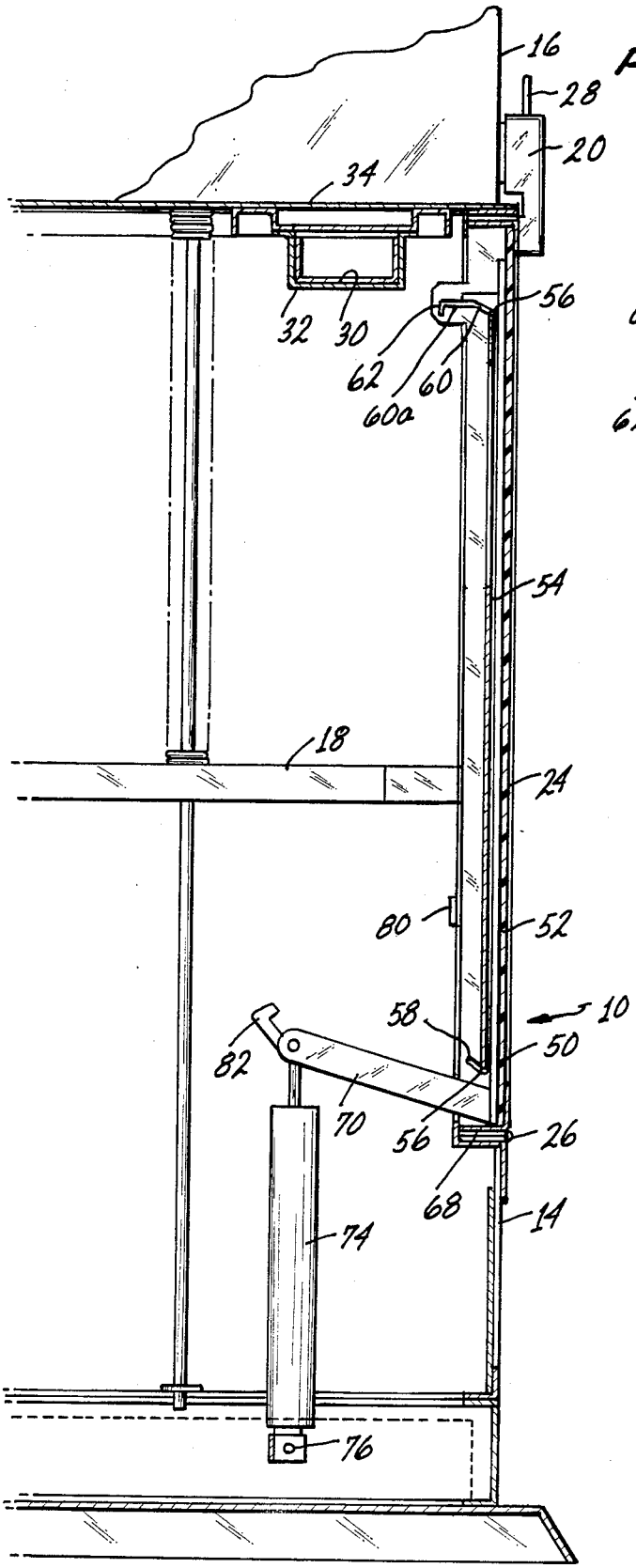
FIG. 4 is a partial view taken in vertical section showing the improved display arrangement on the access door and also showing the novel coin box mounting in section.
Figure 5:
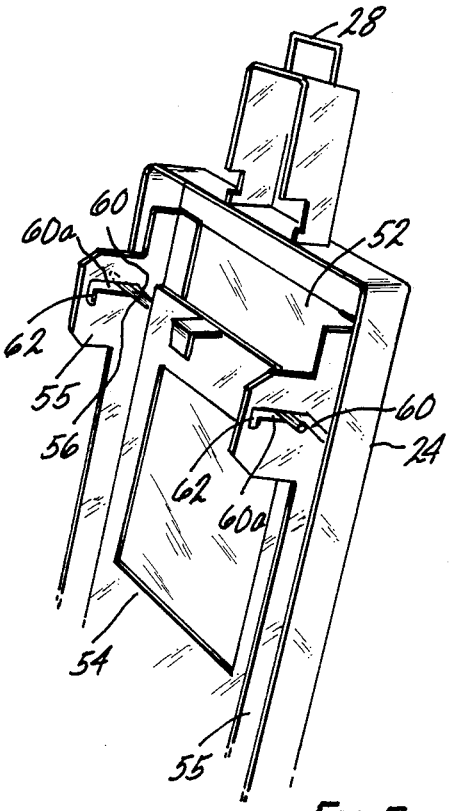
FIG. 5 is a partial perspective view of the display arrangement on the access door.

A further improvement to the vending machine 10 consists of a full page display assembly in the access door 14 for easy insertion and replacement of a display copy of a newspaper or the like. The improved display includes a rectangular window opening 50 dimensioned to permit viewing of substantially the entire front page of a newspaper, and a sheet 52 of transparent material such as transparent plastic mounted within and closing the window opening 50 as best seen in FIG. 1. Turning now to FIGS. 4 and 6, a backing plate 54 is shown supported to the access door 24 by means of four guide pins 56. Two such pins extend from each vertical side of the backing plate and include an upper and a lower pin on each side, the upper pins extending through upper guide slots 58 and the lower pins extending through lower guide slots 60. The guide slots 60 are defined in two parallel vertical sheet metal flanges 55 affixed in perpendicular relationship to the plane of the access door 24. The guide pins 56 are small diameter metal rods welded or otherwise affixed to the backing plate so as to project laterally outward substantially in the plane of the backing plate on each of the two vertical sides of the backing plate and into corresponding guide slots. The guide slots have parallel upper and lower edges and the diameter of the guide pins is somewhat undersized to the width of the guide slots. The two lower guide slots 58 are straight and inclined so as to slope downwardly towards the transparent sheet 52 and the inner surface of the access door 14. The upper guide slots 60 have a forward portion adjacent to the transparent sheet 52 which ramps downwardly in a direction parallel to that of the lower slots 58. However, the upper slots 60, unlike the lower slots 58, extend rearwardly away from the transparent sheet 52 along a horizontal portion **62*a* and terminate in a rear drop notch 62 dimensioned to receive the upper guide pins 56. The upper guide pins 56 are thus movable within the upper guide slots 60 to enable movement of the backing plate from a supporting position shown in FIG. 4 to a spaced position seen in FIG. 6 by simply pulling upwardly and backwardly on the upper end of the backing plate 54. A display copy of a newspaper is thus easily and quickly inserted into place by pulling back on the backing plate and releasing it in its spaced position so that the upper guide pins fall into and are retained in the drop notches 62 of the two upper slots, thus keeping the backing plate from sliding back into adjacent relationship with the transparent plate 52, and supporting the backing plate 54 in spaced relationship to the transparent sheet 52. A display copy 64 is then readily dropped into place in the gap opening 66 defined between the top edge of the backing plate 54 and the transparent sheet 52. The lower edge of the display copy 64 is supported by a horizontal flange or shelf 68 extending along the lower edge of the access door 24. The lower end of the backing plate 54 is maintained in sufficiently spaced relationship to the transparent window sheet 52 so as to allow the lower edge of the display copy 64 to readily pass between the backing plate 54 and the transparent sheet 52, and thus come to rest on the support flange 68. The lower guide pins 56 of the backing plate readily move along the lower guide slots 58 to allow adjustable spacing of the lower portion of the backing plate from the transparent sheet 52 as required by the thickness of the particular display copy. Once the display copy has been so inserted, the backing plate 54 is lifted so as to move the upper guide pins 56 out of the drop notches 62 and the upper portion of the backing plate is pushed forward so as to move the guide pins through the horizontal portions 60a of the upper guide slots and into the downwardly sloping forward portions of the slots 60. The backing plate may then be released and since both the upper and lower guide pins are now within the downwardly sloping portions of their respective guide slots, the guide pins will slide under the weight of the plate 54 along the sloping lower edges of their corresponding guide slots towards the transparent sheet 52 and against the display copy 64, thus sandwiching the display copy between the backing plate 54 and transparent sheet 52. The backing plate continues to bear against the display copy which is thus supported flat against the window sheet 52 and is easily readable through the transparent window sheet 52 from the outside of the machine housing 14**.

In particular, it will be appreciated that no adjustment of the display arrangement is needed for different thicknesses of the display copy. The length of the sloping portions of both upper and lower guide slots 58 is such as to allow the backing plate 54 to admit the thickest display copy likely to be inserted, and after such insertion the backing plate slides down and bears against the display copy regardless of its thickness. The forward end of the guide slots are desirably spaced from the window sheet 52 a distance less than the thickness of the thinest display copy. The backing plate merely slides until it is stopped by the display copy held against the transparent sheet 52. The height of the backing plate 54 is such as to provide adequate support of the display copy along the entire height of the display copy page. The lower edge of the backing plate 54 is spaced upwardly from the display copy support flange 68 but such spacing is not so great as to deprive the lower portion of the display copy of adequate support and allow it to fold under its own weight, i.e. the rigidity of the display copy is sufficient to maintain the lower portion thereof not covered by the backing plate 54 in an erect position.

Figure 8:
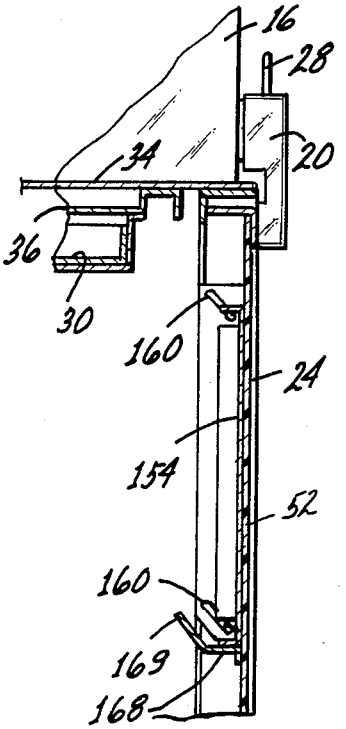
FIG. 8 is a partial cross-sectional view taken in elevation showing an alternate display copy support arrangement in closed position.
Figure 9:
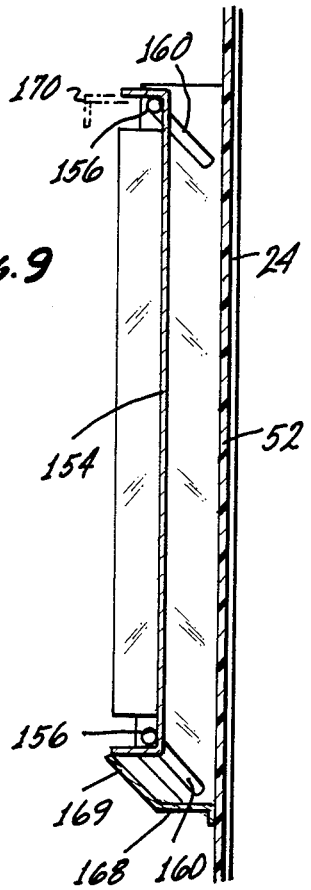
FIG. 9 is a view as in FIG. 8 showing the display copy support in open position.
Figure 10:
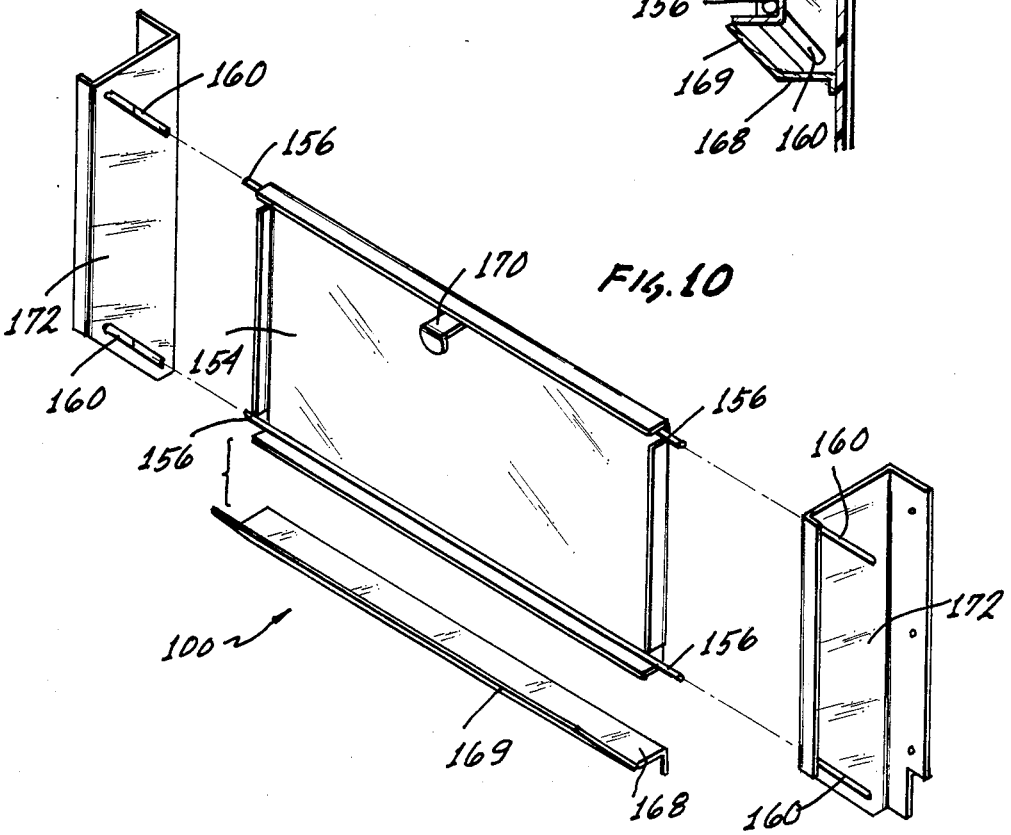
FIG. 10 is an exploded perspective view of the display copy support components shown separated from the access door.

In an alternate and presently preferred embodiment of the display copy arrangement 100, shown in FIGS. 8–10 and wherein like elements bear like numbers to those of FIGS. 1–7, a modified display copy support 168 is rearwardly extended by a portion 169 slanted generally parallel to the four guide slots 160 such that when the display copy is dropped in place between backing plate 154 and the window sheet 52, the lower edge of the display copy is caught by the sloping portion 169 and slides down along the support surface towards the transparent window sheet 52. In the embodiment of FIGS. 8–10, four substantially similar and mutually parallel guide slots 160 are provided in two flanges 172 fixed to the access door 24 of the vending machine, all guide slots sloping downwardly towards the window sheet 52. No drop notch is provided in the upper guide slots because insertion of the display copy is so quick and convenient that it is not essential to provide the same. The backing plate 154 is merely pulled upwardly by means of a pull tab 170 affixed to its upper edge, such that the four guide pins 156 of the backing plate slide upwardly along the upper edges of the four guide slots 160 bringing the backing plate into spaced relationship with the transparent window sheet 52 as shown in FIG. 9. The backing plate is briefly held up in said spaced position while the display copy is dropped into place between the backing plate 154 and the window sheet 52, after which the backing plate is released and falls back under its own weight, sliding along the lower edges of the guide slots 160, against the display copy to support the same flat against the transparent sheet 52 as shown in FIG. 8.

A still further aspect of the present invention is directed to an improved access door spring loading and limiting arrangement seen in its entirety in FIG. 1. The access door 24 is provided with two parallel rigid arms 70 affixed at its lower end near the left and right side edges of the door 24, as better seen in FIGS. 4, 6 and 7. The access door 24 is spring loaded towards the closed position shown in FIGS. 1 and 4 by means of a hydraulic door closer 74 connected between the free end 72 of the left door arm 70 (as seen in FIG. 1) and the base of the machine housing 14 at 76, and a coil spring 75 connected between the free end 72 of the right door arm 70 and the machine base. Thus, when the access door is pivoted at hinge 26 towards an open position as in FIG. 6, the both door arms 70 swing in an upward arc, stretching the spring 75 and the closer 74 towards their extended positions. Both the closer 74 and coil 75 resist such extension and will tend to return to its normal state by pulling down on the outer end 72 of the door arms 70, to close the door 24 when it is released. Prior art machines commonly provided coil springs for returning the access door to a closed position. Coil springs however suffer from various disadvantages as described in this applicant's co-pending patent application Ser. No. 609,692 now abandoned and provision of a hydraulic door closer 74 of the type specified in said co-pending application delivers smoother, quieter and safer door closing action in that it dampens the force of the spring 75. A limiting tab 80 is fixed to the machine housing 14 on each side of the door 24 so as to project into the access door opening and stop upward pivoting movement of the door arms 70 at the position shown in FIG. 6 so as to limit the opening of the door 24 and thus prevent damage to the hydraulic door closer 74 due to over-extension and excessive pulling force on the same as well as excessive stretching of the spring 25.

A latch hook 82 is pivotably mounted to the left door arm 70 and may be swung into latching engagement with the corresponding limiting tab 80 when the door is pulled to its maximum open position of FIG. 6, so as to prevent the outer end 72 of arm 70 from being pulled away from the limiting tab 80 by the spring action of the hydraulic door closer 74. The latch element 82 is easily manually pivoted into engagement with the arresting tab 80 by the service person, yet is inobtrusive to the average patron of the vending machine so as not to invite tampering therewith, i.e. as by maliciously locking the door in its open position. FIG. 7 shows in detail the limiting tab 80 on the right side of the access door 24 provided with a coil spring 75 rather than the hydraulic door closer and wherein no locking latch 82 is provided, but only a limiting tab 80 so as to limit opening of the access door 24. In FIG. 6, the aforementioned door restraining latch 82 is shown for holding the access door 24 in the open position as illustrated. The door latch hook 82 may be seen in its disengaged normal position in FIG. 4. The dual function of the door limiting tab 80 and its cooperative relationship with the door restraining hook 82 will be appreciated.

The present invention has been shown and illustrated for purposes of clarity and by way of example only. Many changes, substitutions, and modifications to the described embodiments will become apparent to those possessed of ordinary skill in the art. Therefore, the foregoing examples should not be taken by way of limitation of the scope of the present invention which is defined only by the following claims.

What is claimed is:

1. In a vending machine having a primary enclosure for storing articles to be vended, said enclosure including an access door, a coin operated door locking mechanism and a coin box for receiving coins accepted by said door locking mechanism, said primary enclosure including a top wall and said coin operated door locking mechanism being housed in a secondary enclosure mounted on said top wall and having a key operated secondary access door thereinto, the improvement comprising:

said coin box being supported under a coin drop opening defined in said top wall within said primary enclosure for ready access thereto through said access door and coin box lock means securing said coin box against removal from said primary enclosure, whereby mutually exclusive access may be had to each of said coin operated door locking mechanism and said coin receiving box; said coin box having a top opening for removing coinage from said box said box being removably supported against said top wall, said top wall closing access into said top opening to prevent removal of coinage in said coin box by persons having access into said primary housing without first opening said coin box lock means.

2. The improvement of claim 1 wherein said coin box is supported substantially against the underside of said top wall by means of slide supports affixed to the top wall, said coin box being removable from said slide supports for emptying the box of accumulated coinage, said coin box lock means securing said coin box lock means securing said coin box in underlying relationship with said coin drop opening against removal from said slide supports.

3. The improvement of claim 2 wherein said coin box lock means is a padlock securing said coin box to said primary housing, said padlock being protected within said primary housing against the elements.

4. In a vending machine having a primary enclosure for storing articles to be vended, said enclosure including an access door, a coin operated door locking mechanism and a coin box for receiving coins accepted by said door locking mechanism, said primary enclosure including a top wall and said coin operated door locking mechanism being housed in a secondary enclosure mounted on said top wall and having a key operated secondary access door thereinto, the improvement comprising:

a pull-down access door hinged at its lower end to said housing said access door having a display window opening closed by a transparent sheet having an upper end and a lower end said transparent sheet being sufficiently large to display an unfolded newspaper page;

article support means affixed to said door below said transparent sheet for supporting a newspaper or the like in register with said window for viewing by prospective purchasers;

a backing plate extending substantially at least from said upper to said lower ends of said transparent sheet;

plate support means including inclined slide means arranged for limited movement of the plate away from said transparent sheet, in response to upward pulling force on said plate along a force line substantially parallel to said access door, said slide means configured such that said backing plate when released normally tends to slide under its own weight from a position spaced from said transparent sheet allowing easy insertion of a display copy of a newspaper of the like between said plate and transparent sheet towards said transparent sheet, said plate remaining generally parallel to said transparent sheet at all times said slide means limiting the spacing between said plate and said transparent sheet so as to allow easy sliding insertion of a newspaper therebetween but maintaining said plate sufficiently close for supporting erect an unfolded newspaper during insertion and holding flat said newspaper or the like against said transparent sheet after release of said plate from said spaced position.

5. The improvement of claim 4 wherein said slide means are operative for directing said backing plate to said spaced position in response to generally upward pulling force applied to said plate, said plate dropping towards said transparent sheet when released.

6. The improvement of claim 4 wherein said plate support means comprise flange means affixed to said access door, one or more guide slots in said flanges, said slots extending at an angle downwardly and towards said access door, said plate having portions slideably supported in said slots.

* * * * *